US011661791B2

(12) United States Patent
Katcher et al.

(10) Patent No.: US 11,661,791 B2
(45) Date of Patent: May 30, 2023

(54) RETRACTABLE SECURITY BARRIER

(71) Applicants: David A Katcher, Kennewick, WA (US); Sheryl A Katcher, Kennewick, WA (US)

(72) Inventors: David A Katcher, Kennewick, WA (US); Sheryl A Katcher, Kennewick, WA (US)

( * ) Notice: Subject to any disclaimer, the term of this patent is extended or adjusted under 35 U.S.C. 154(b) by 383 days.

(21) Appl. No.: 16/900,862

(22) Filed: Jun. 12, 2020

(65) Prior Publication Data

US 2020/0355024 A1 Nov. 12, 2020

Related U.S. Application Data

(63) Continuation-in-part of application No. 16/360,022, filed on Mar. 21, 2019, now abandoned.

(51) Int. Cl.

| | |
|---|---|
| ***E06B 9/00*** | (2006.01) |
| ***E06B 9/08*** | (2006.01) |
| ***E05C 19/12*** | (2006.01) |
| *E06B 9/60* | (2006.01) |

(52) U.S. Cl.

CPC ..... *E06B 9/08* (2013.01); *E05C 19/12* (2013.01); *E06B 9/60* (2013.01); *E06B 2009/002* (2013.01)

(58) Field of Classification Search

CPC ..... E06B 2009/002; E06B 9/08; E06B 9/18; E06B 9/60; E06B 9/54; E06B 2009/445; E06B 2009/543; E06B 2009/546; E06B 9/56; E06B 2009/801; E06B 2009/804; E06B 9/86; E06B 5/10; E05C 19/12; F14H 5/24; E05B 65/0028; E05B 65/0085; E05B 65/08; E05B 65/0835; E05B 65/0847; E05B 63/0052; E05B 63/12; E05B 63/24; E05B 63/244; Y10T 292/444; Y10T 292/68; Y10T 292/696; Y10T 292/702

See application file for complete search history.

(56) References Cited

U.S. PATENT DOCUMENTS

| | | | | |
|---|---|---|---|---|
| 3,050,322 A * | 8/1962 | Miller | E05B 65/08 | D8/DIG. 1 |
| 4,651,797 A * | 3/1987 | Lange | E06B 9/40 | 160/28 |
| 5,246,054 A * | 9/1993 | Shepherd | E06B 9/86 | 160/133 |
| 5,450,888 A * | 9/1995 | Schwartzman | E06B 9/54 | 160/10 |
| 5,505,244 A * | 4/1996 | Thumann | E06B 9/54 | 160/290.1 |
| 7,591,492 B2 * | 9/2009 | Nikkhah | E05B 65/0835 | 292/210 |

(Continued)

*Primary Examiner* — Marcus Menezes
*Assistant Examiner* — Jeremy C Ramsey
(74) *Attorney, Agent, or Firm* — Mark S Hubert PC

(57) ABSTRACT

A retractable, coilable, security barrier screen easily mounted around a door, window or other building opening such as a hallway entrance. The barrier is designed to withstand considerable forces from blunt force strikes, bullets and edged weapon slashing. As such, it has a strengthened spool tube, novel security barrier attachment methods, and redundant operational features such as dual (top and bottom spool locks), quad spool locking pins and a dual attachment for the fabric security barrier to the screen lock strip that includes both gluing and plate riveting.

7 Claims, 17 Drawing Sheets

(56) References Cited

U.S. PATENT DOCUMENTS

| | | | | |
|---|---|---|---|---|
| 9,702,665 | B1 * | 7/2017 | Rose, Jr. | E06B 9/13 |
| 10,209,036 | B1 * | 2/2019 | Rose, Jr. | F41H 5/0485 |
| 2001/0035268 | A1 * | 11/2001 | Desrochers | E06B 9/54 160/31 |
| 2017/0254119 | A1 * | 9/2017 | Raz | E05B 17/2057 |
| 2018/0305977 | A1 * | 10/2018 | Balay | E06B 9/11 |
| 2019/0390517 | A1 * | 12/2019 | Miller | E06B 9/86 |
| 2021/0285743 | A1 * | 9/2021 | Adrain | B32B 27/065 |

* cited by examiner

FIG. 1
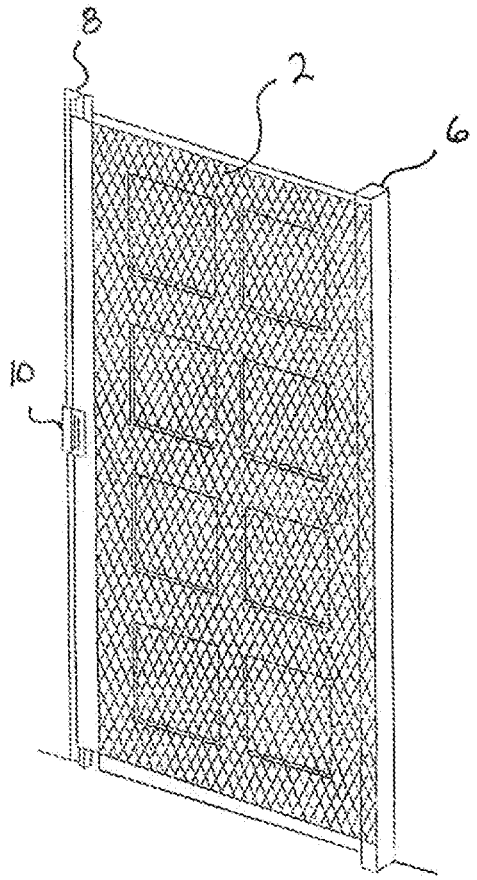
FIG. 2
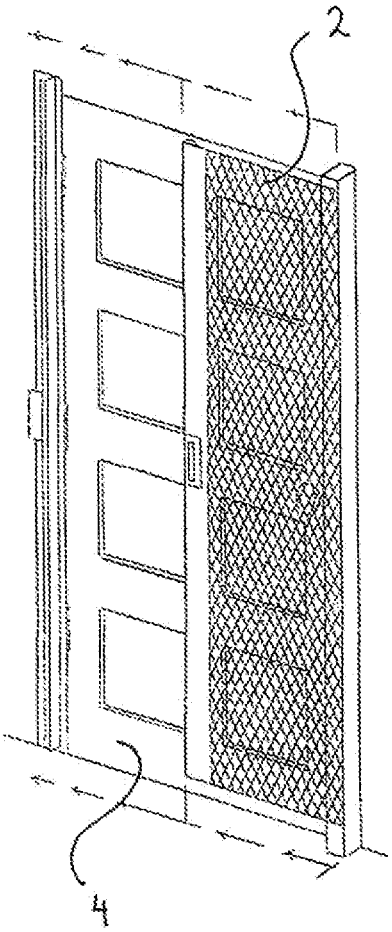
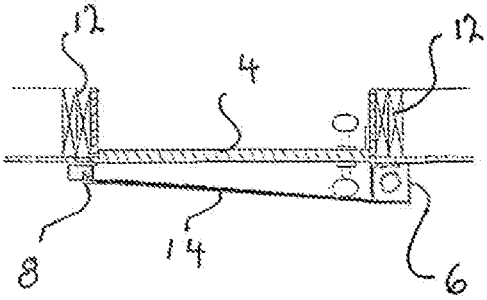
FIG. 3

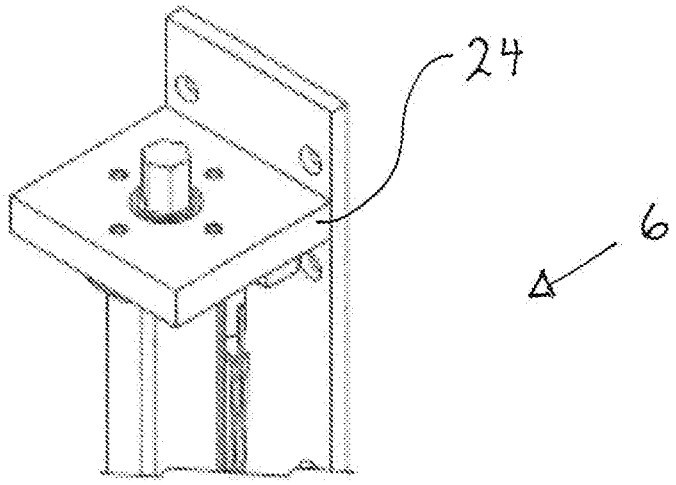
FIG. 8
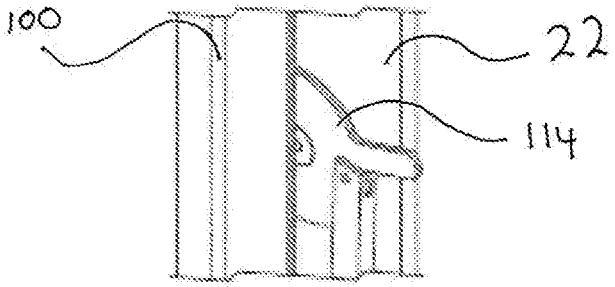
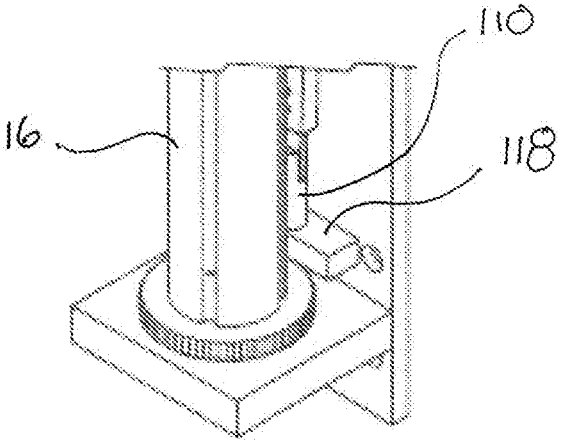

FIG 21
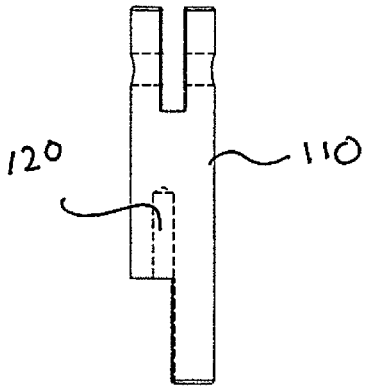
FIG. 22
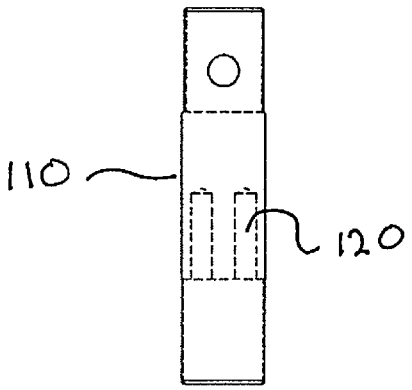
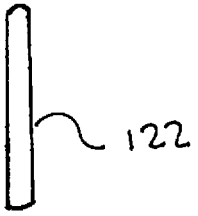
FIG. 23
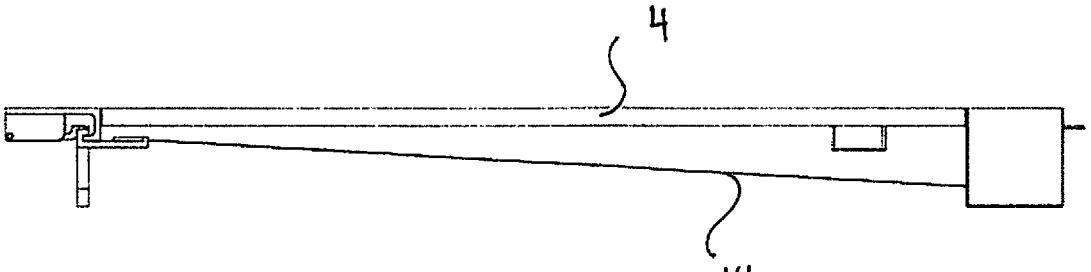
FIG. 27

FIG. 25
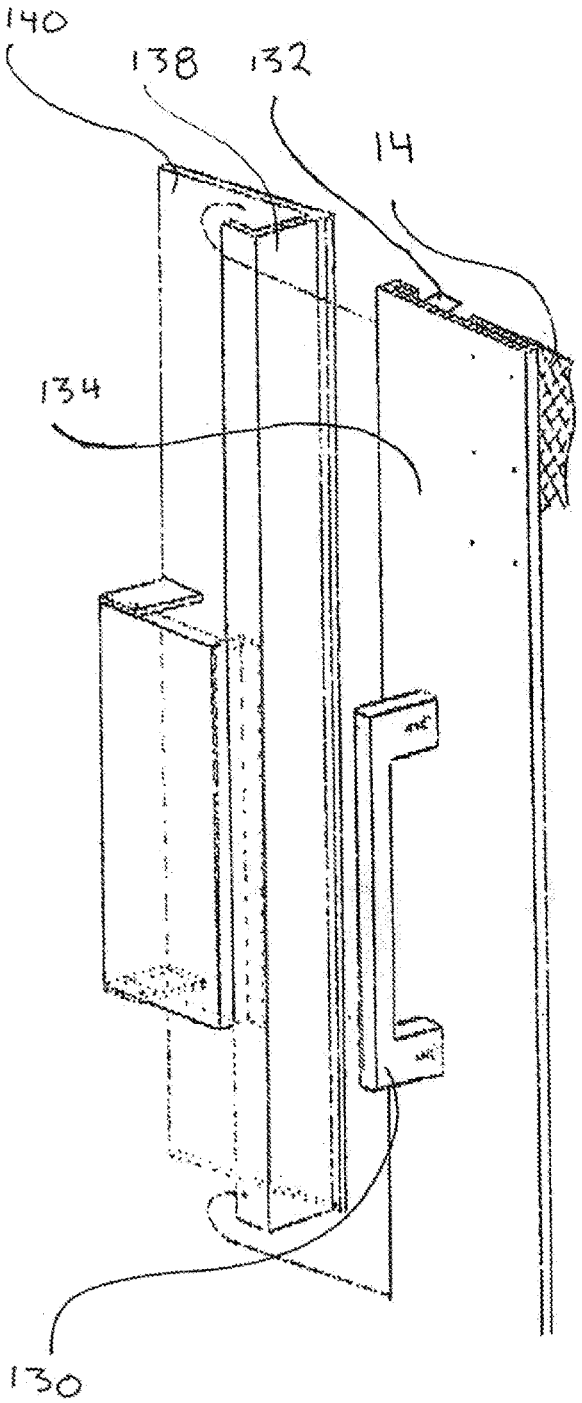
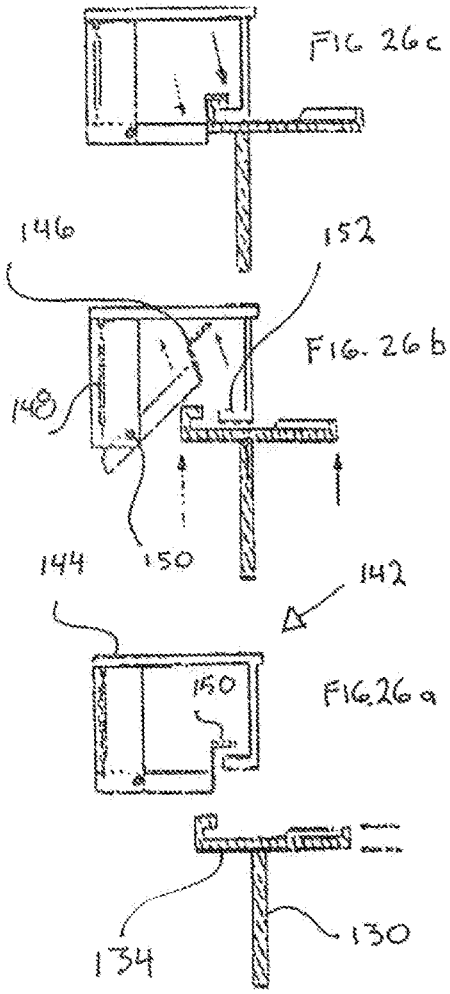

RETRACTABLE SECURITY BARRIER

CROSS-REFERENCE TO RELATED APPLICATIONS

This application is a continuation in part of U.S. patent application Ser. No. 16/360,022 filed Mar. 12, 2019, which is incorporated by reference herein in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to protective barriers, and more particularly to door and window security technology.

BACKGROUND

Nowadays, the news is repeat with stories of mass murders occurring at schools, sporting events, entertainment venues, shopping centers and workplaces. Generally, these random, unprovoked acts of violence are performed with a gun or knife. While bulletproof glass windows and doors are well known, these are expensive to purchase and install. This is especially true for schools as they have a plethora of classroom and facility doors and windows making this option prohibitively expensive. Furthermore, bullet proof ratings require that the bulletproof window or door be able to withstand a hefty barrage of attempts—far more than by a criminal rushing about with a limited supply of bullets puts forth.

Also, these bulletproof windows and doors are heavy for a young child to have to secure and lock. What is needed is an inexpensive, lightweight, easy to close and lock barrier that can resist a reasonable number of bullets, slashing and blunt force applications, and that can be easily retrofitted onto existing doorways and windows.

Henceforth, a door and window barrier that provided heightened levels of protection against intrusion would fulfill a long felt need in the security industry. This new invention utilizes and combines known and new technologies in a unique and novel configuration to overcome the aforementioned problems and accomplish this.

BRIEF SUMMARY

In accordance with various embodiments, a retractable, bulletproof, slash-proof, protective barrier that can withstand moderated blunt force strikes and that may be mounted over existing doorways, is provided.

In one aspect, an easy to close vertical security roller door screen barrier is provided. It rolls vertically into its door mounted housing.

In another aspect, an inexpensive, intrusion-proof retractable door screen barrier that easily mounts to a conventional door jam, is provided.

In a final aspect, a quick to establish protective barrier with reinforced construction and redundant locking.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 1 is a perspective front view of the retractable security barrier extended;

FIG. 2 is a perspective front view of the retractable security barrier partially extended;

FIG. 3 is a top view of the retractable security barrier drawn across a doorway and locked in place;

FIG. 8 is a side perspective view of the screen assembly;

FIG. 21 is a side view of the lock guide without the two lock pins;

FIG. 22 is a front view of the lock guide without the two lock pins;

FIG. 23 is a side view of a lock pin;

FIG. 25 is an enlarged view of the bump lock;

FIGS. 26 *a-c* are top views of the bump lock operation in sequential steps; and FIG. 27 is a top view of the security barrier in a fully extended and locked position.

DETAILED DESCRIPTION

Figure 4:
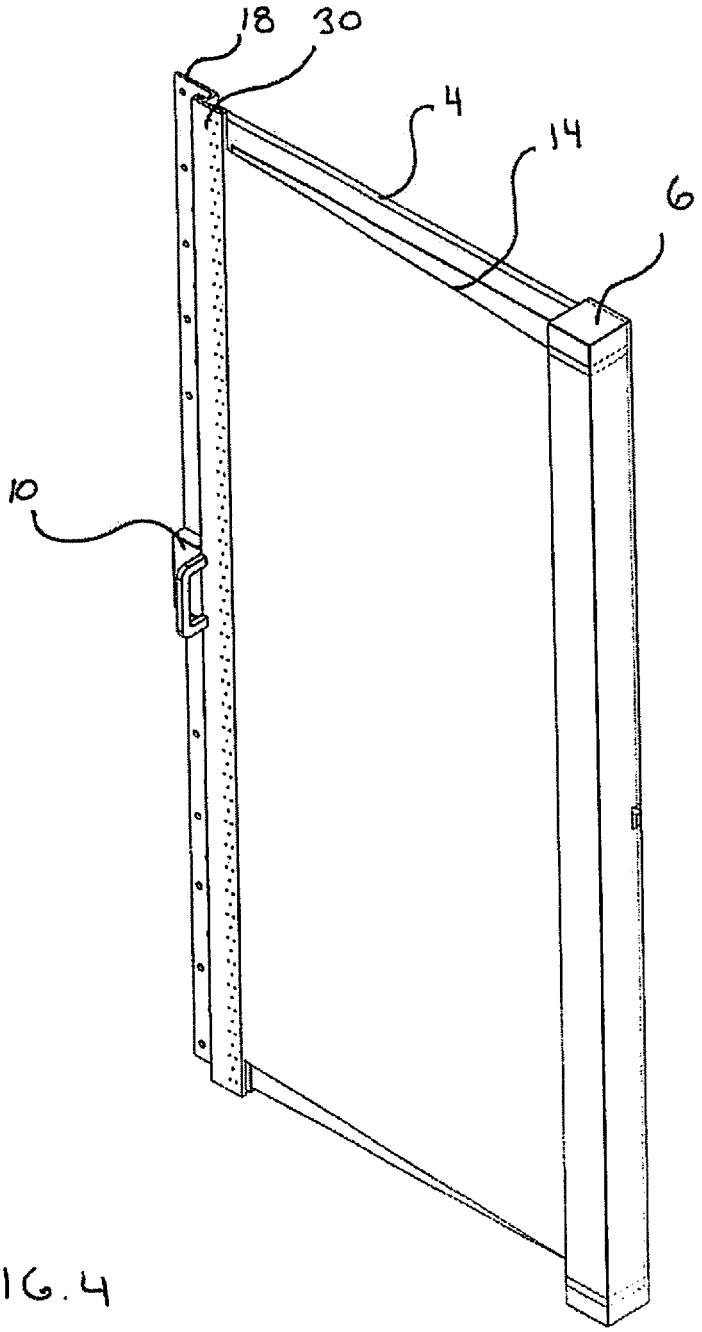
FIG. 4 is a perspective top view of the retractable security barrier extended.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention. The accompanying drawings are not necessarily drawn to scale.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items.

In the following description, for the purposes of explanation, numerous specific details are set forth in order to provide a thorough understanding of the described embodiments. It will be apparent to one skilled in the art, however, that other embodiments of the present invention may be practiced without some of these specific details. It should be appreciated that the features described with respect to one embodiment may be incorporated with other embodiments as well. By the same token, however, no single feature or features of any described embodiment should be considered essential to every embodiment of the invention, as other embodiments of the invention may omit such features.

As used herein, the term "bullet resistant" refers to the ability of the fabric security barrier to stop some lower power, lower caliber bullets but only slow or retard larger caliber, higher powered bullets. For each different bullet resistant fabric there will be a threshold amount of kinetic energy that must be exceeded to allow a bullet of a specific shape to pass through. Bullet resistant is not bullet proof.

As used herein the term "slash resistant" refers to the ability of the fabric security barrier to not separate upon the application of a single slashing force from an edged object. Repeated slashing forces applied to the same area may result in a separation/tear in the fabric depending on the amount of force, the number of applications of the force and the sharpness of the edged object. Slash resistant is not slash proof.

As used herein the term "blunt force resistant" refers to the ability of the fabric security barrier to not separate upon the application of a single blunt force as well as the ability of the fabric security barrier not to detach from the spool or screen capture assembly. Repeated blunt forces applied to the same area may result in a failure or breach depending on the magnitude of the blunt force application and the number of applications of the force. Blunt force resistant is not blunt force proof.

The present invention relates to a novel design for a retractable, coilable, security barrier screen easily mounted around a door, window or other building opening such as a hallway entrance. The barrier is designed to withstand considerable forces from blunt force strikes, bullets and edged weapon slashing. As such, it has a strengthened spool tube, novel security barrier attachment methods, and redundant operational features such as dual (top and bottom spool locks), quad spool locking pins and a dual attachment for the fabric security barrier to the screen lock strip that includes both gluing and plate riveting.

Looking at FIGS. 1-3 and 27 the complete retractable security barrier ("barrier") 2 can be seen installed about the sides of a conventional door 4. Although depicted in all figures as mounted to the left and right sides of a door 4, this is only for demonstrative purposes. It may be mounted vertically or horizontally about any building wall opening such as a window, hallway, doorway or the like. It is designed to withstand blunt force stretching, tearing or spool/locking assembly release, is slash resistant and bullet resistant. The barrier 2 is comprised of the following main three components: a screen assembly 6, a locking assembly 8, and a bump lock assembly 10. Each of these components are assemblies make of their constituent components as outlined herein.

In simplest terms, the screen assembly 6 and the locking assembly 8 are secured to the framing studs 12 behind the opposing walls by mechanical fasteners such as screws, nails, nuts and bolts, anchors or their functional equivalent. (In the case of brick, block or cement or concrete walls anchors or nuts and bolts will be preferably utilized.) The screen 14 is stretched by a handle at its proximal end, from its coiled position in the screen assembly 6 to the locking assembly 8 and secured there in a taut fashion by the bump lock assembly 10 as well as a mating engagement between the screen hook strip 20 and the screen lock strip 18. The screen 14 is fed out in a taut fashion by a torsion assembly within the spool tube 16. The distal end edge of the screen 14 is permanently affixed by gluing into one of the four linear concave troughs 38 formed along the length of the spool tube 16 which is locked from rotating and allowing the screen 14 from leaving its taut locked position. The proximal end edge of the screen 14 is parallel to the distal end edge and is permanently affixed by gluing and sandwiching between two steel strips mechanically affixed together (preferably by rivets.) When extended as outlined, the barrier hampers, deters, slows or stops the intrusion of unwanted people or actions from their weapons.

The screen 14 is selected for its strength and is slash resistant to protect from knife or edged weapon assaults, bullet resistant and tear resistant from blunt force impacts. The fabric screen barrier may be made from a single sheet of material or from a multiple layers of differing materials. The materials for this barrier are selected from the set of strengthened fabrics including but not limited to Cordura® Balistic Fabric (woven with high tenacity nylon 6,6 filament yarns), HPPE (high performance polyethylene), Dyneema® Composite Fabric (a non-woven composite material constructed from a thin sheet of ultra-high-molecular-weight polyethylene (UHMWPE, "Dyneema®") laminated between two sheets of polyethylene terephthalate (PET, generic) or BoPET ("Mylar®"), Tyvek (flashspun high-density polyethylene fibers), and/or Kevlar®/Kovenex® (Poly-paraphenylene terephthalamide). The actual fabric used is beyond the scope of this patent except it must exhibit extreme resistance to slashes, bullet penetration and blunt force tearing.

The actual fabric barrier ("screen") 14 has its distal end glued and/or mechanically fastened to the spool 16 and its proximal end glued and/or mechanically fastened to the locking assembly 8. Preferably the screen 14 will be glued (preferably with an acrylic or epoxy high strength UV cured resin) to these components. Gluing offers a superior holding strength with each of the openings and 360 degrees of the fibers of the screen 14 synergistically contributing to this strength. Additional plates and mechanical fasteners such as rivets, or sealing strips may be used as additional redundant holding strength.

Figure 5:
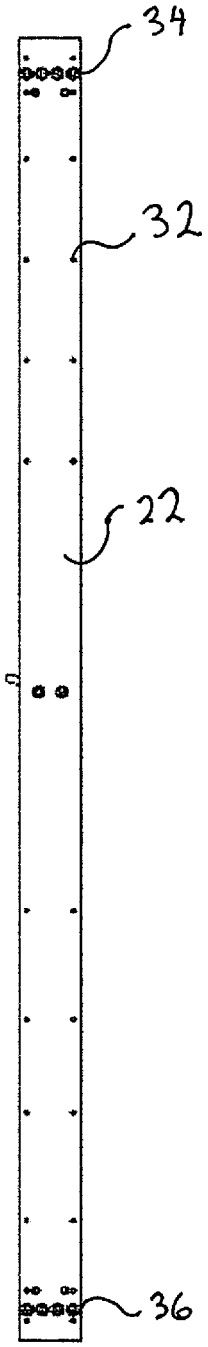
FIG. 5 is a rear view of the screen mounting plate.
Figure 7:
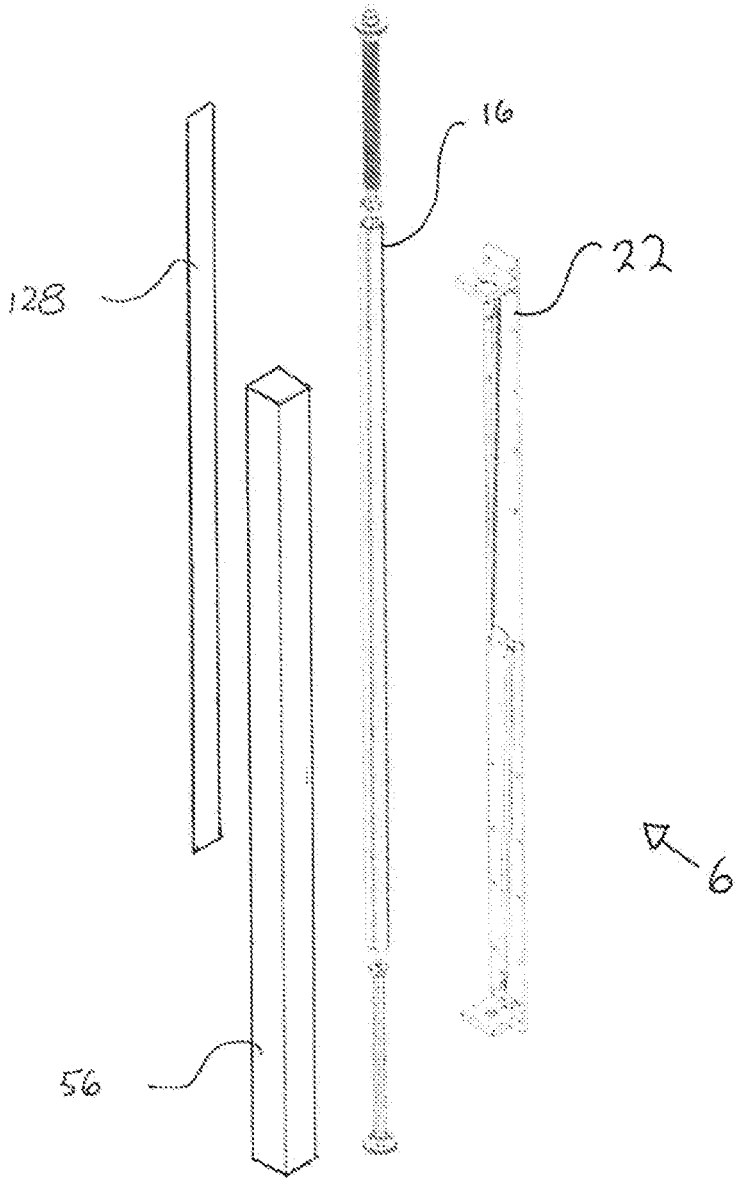
FIG. 7 is an exploded perspective front view of the screen assembly.
Figure 9:
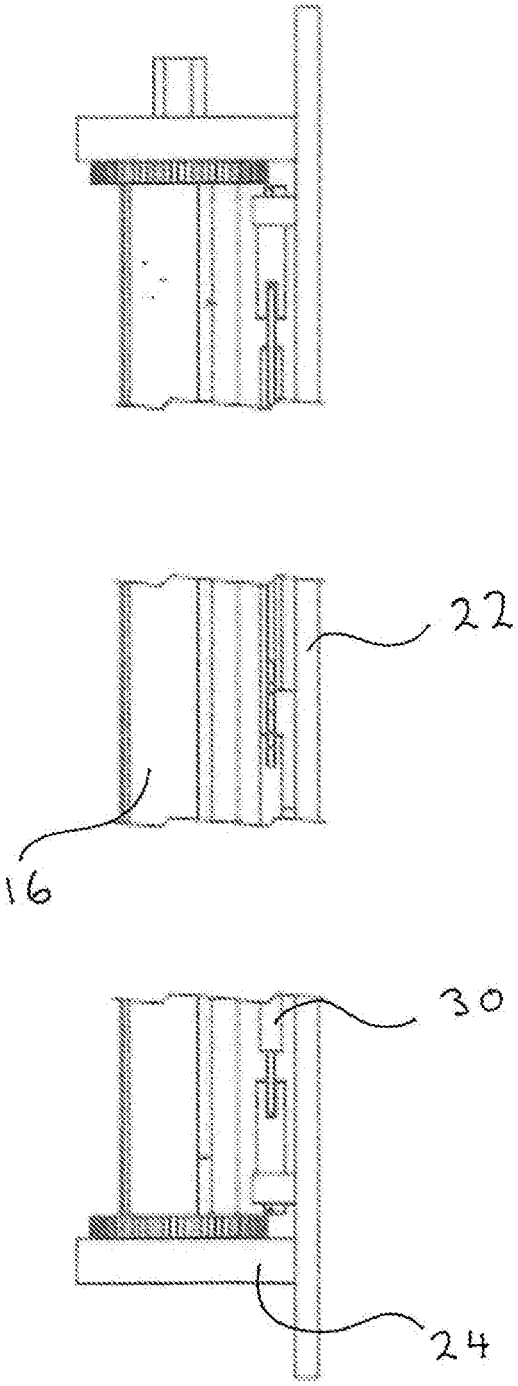
FIG. 9 is a side view of the screen assembly.
Figure 10:
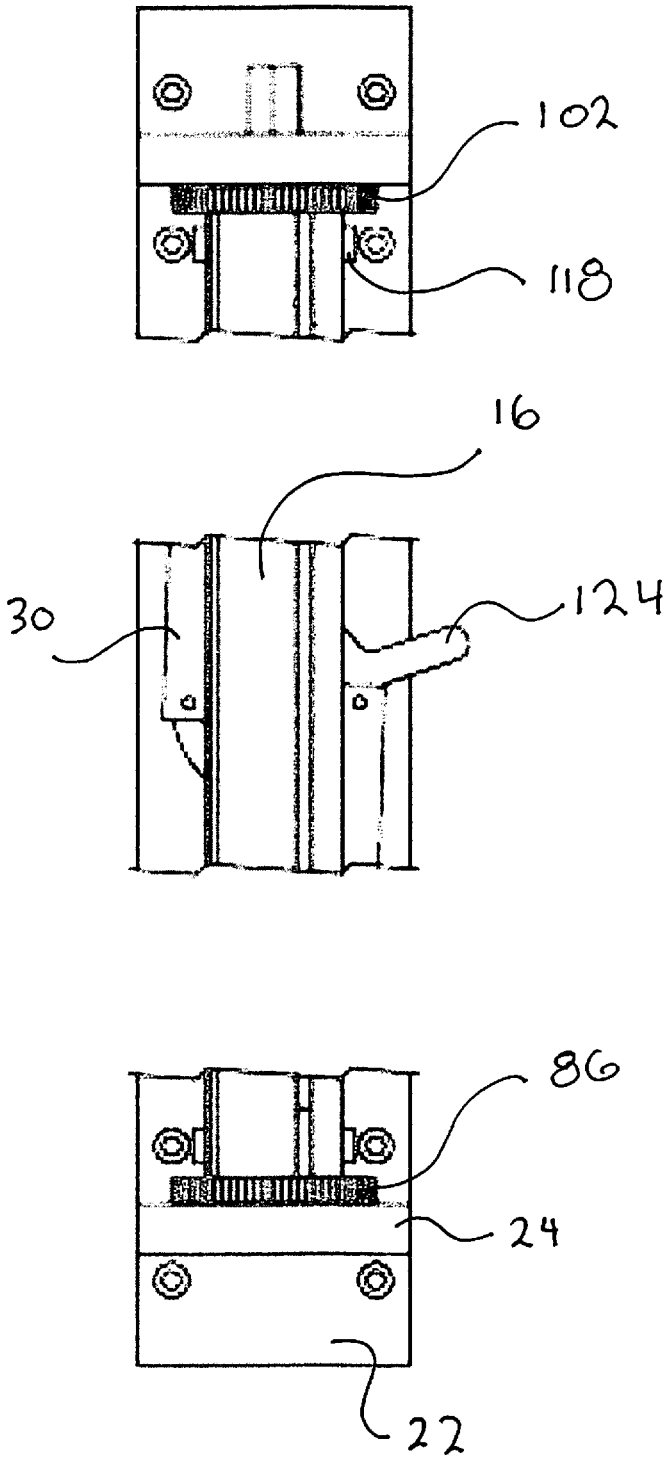
FIG. 10 is a front view of the screen assembly.
Figure 12:
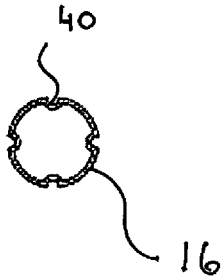
FIG. 12 is a transverse cross sectional view of the spool tube.
Figure 11:
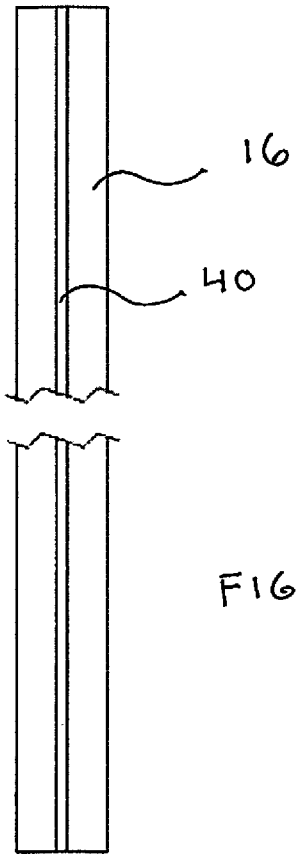
FIG. 11 is a front view of the spool tube.
Figure 14:
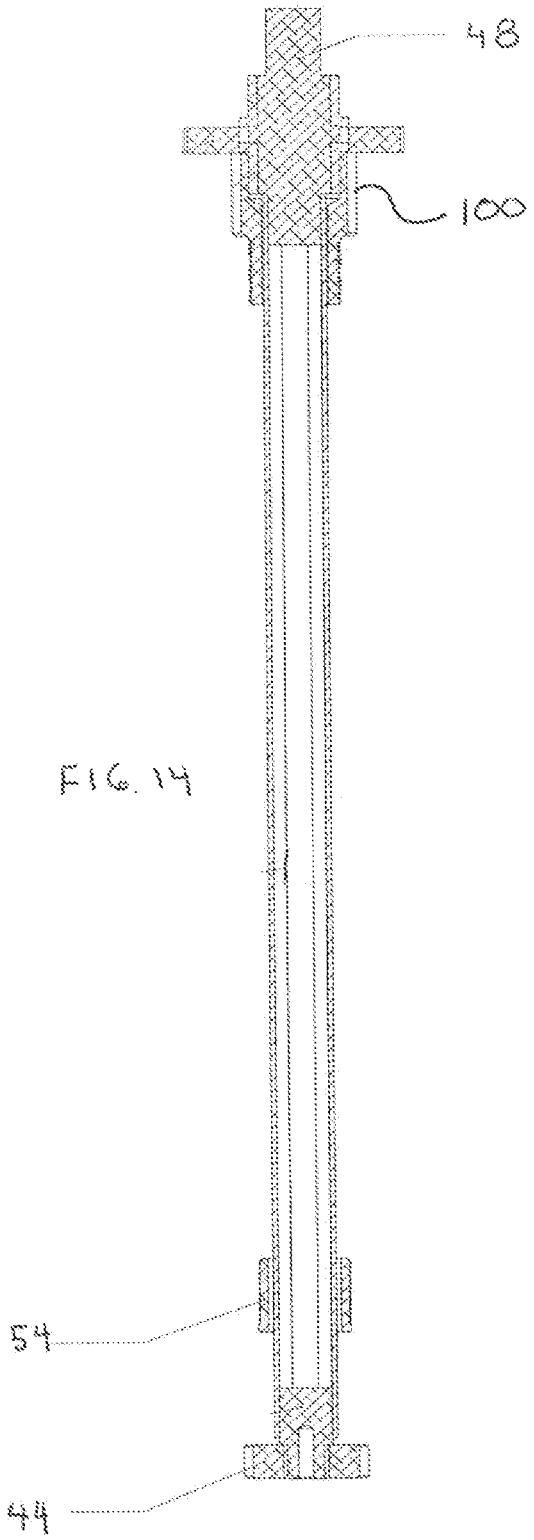
FIG. 14 is a cross sectional view of the torsion assembly taken through section line A of FIG. 13.
Figure 13:
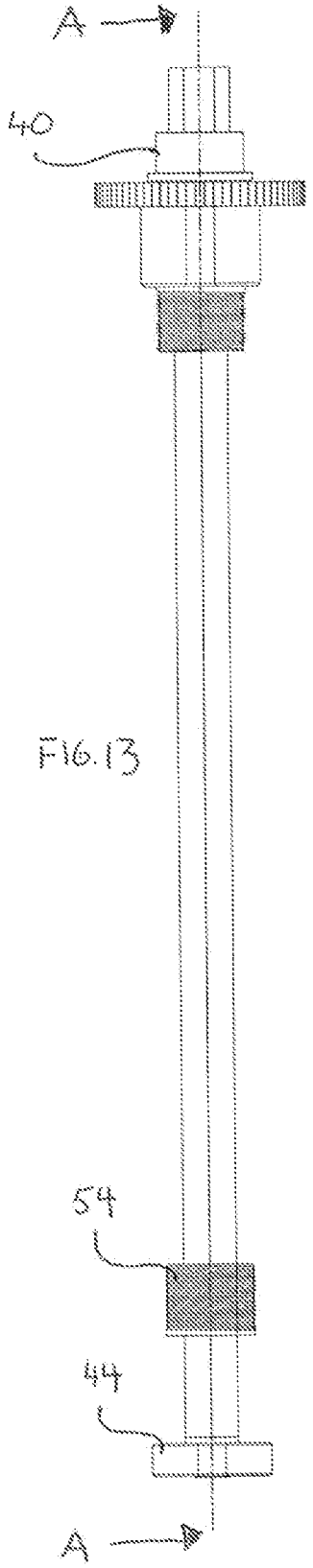
FIG. 13 is a side view of the torsion assembly without the torsion spring.
Figure 15:
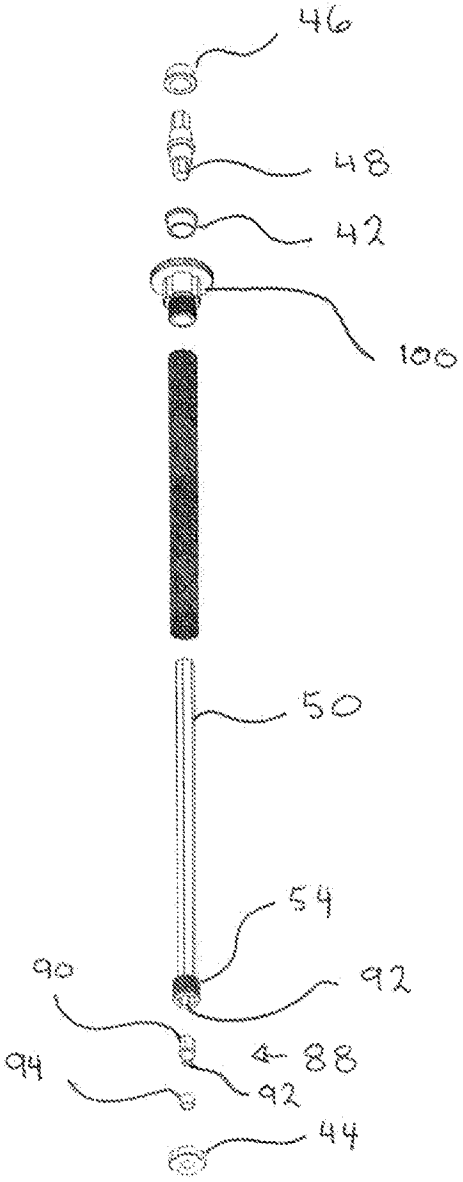
FIG. 15 is a perspective side assembly view of the torsion assembly.
Figure 16:
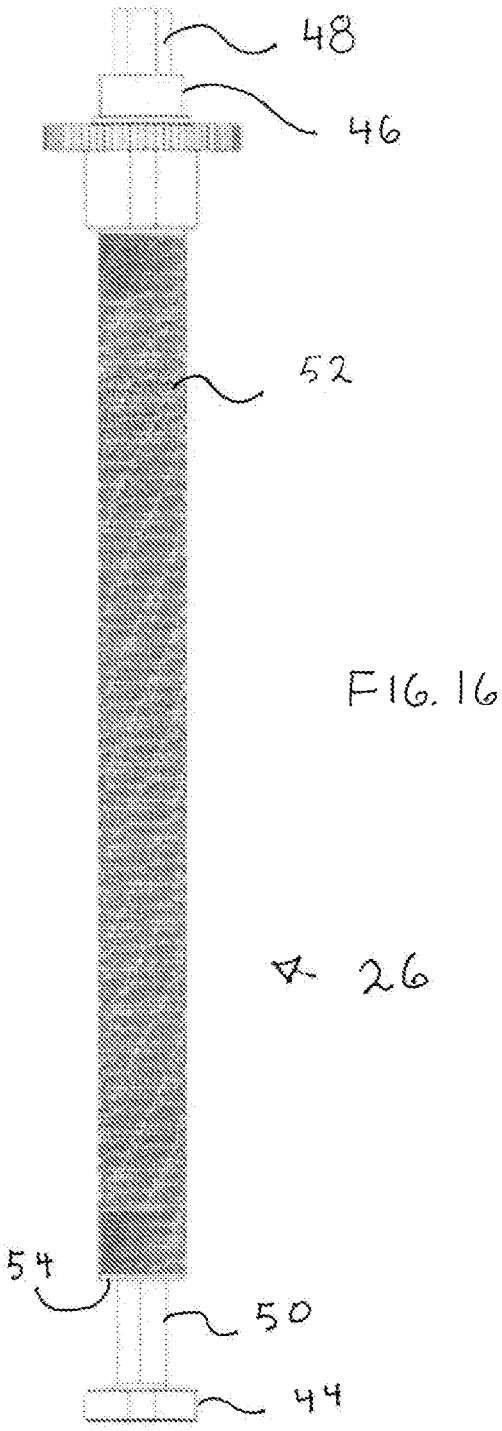
FIG. 16 is a side view of the torsion assembly.
Figure 17:
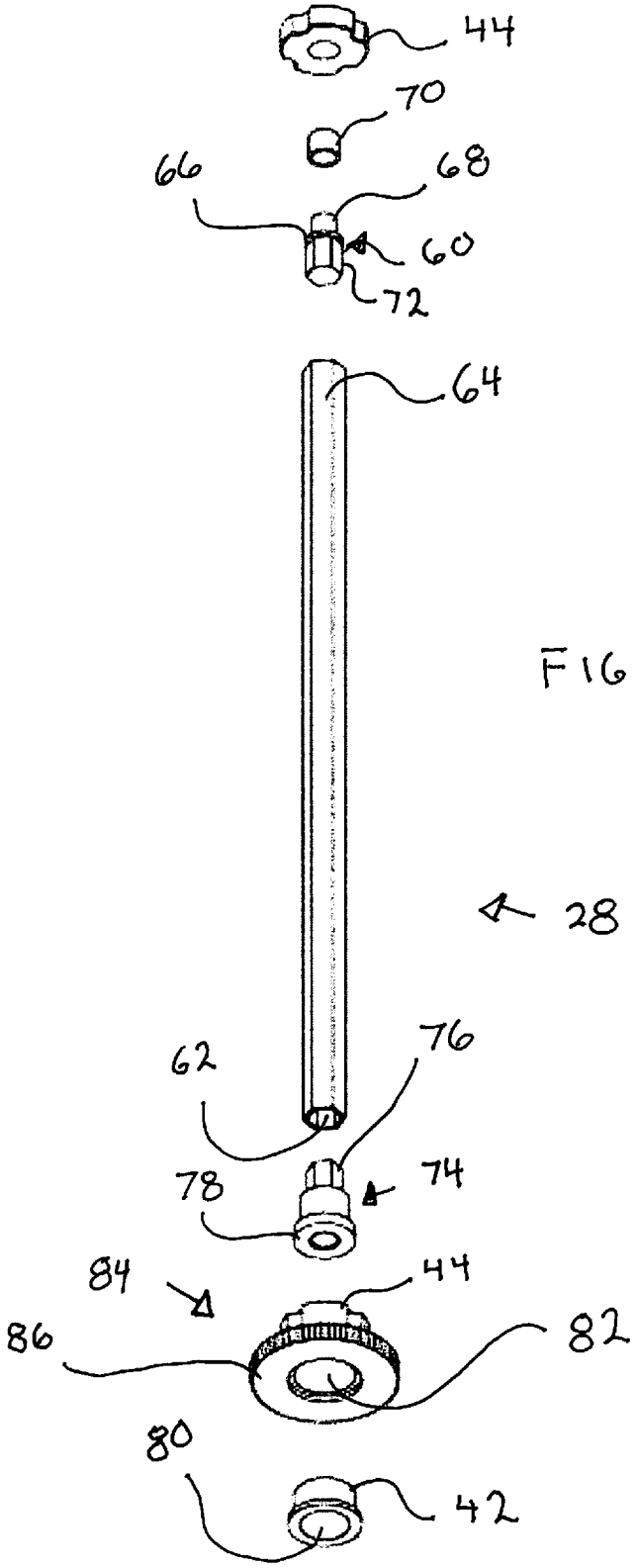
FIG. 17 is a perspective side assembly view of the stabilizer assembly.
Figure 18:
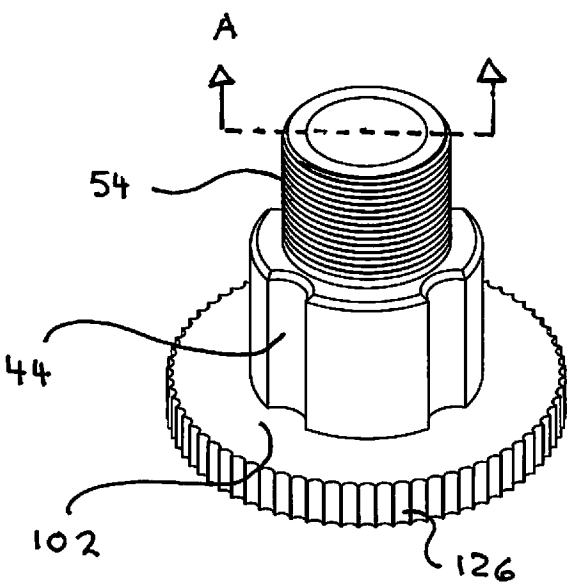
FIG. 18 is a perspective side view of the lock cog assembly.
Figure 19:
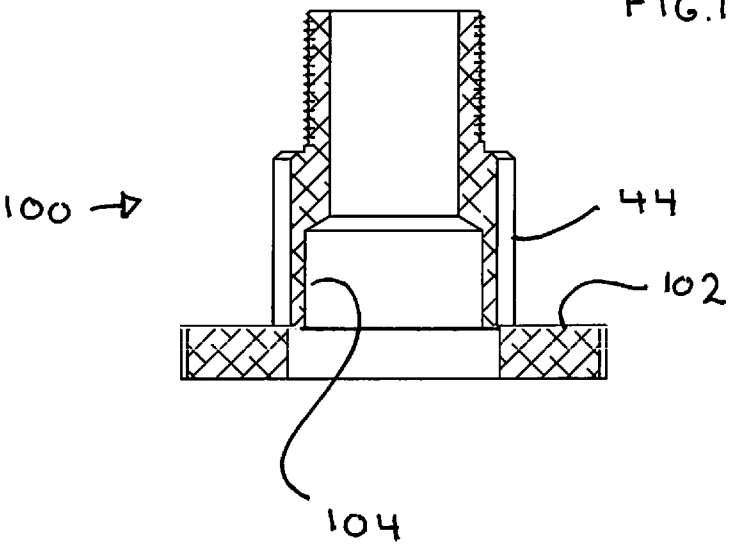
FIG. 19 is a cross sectional view of the lock cog assembly taken through section line A-A of FIG. 18.
Figure 20:
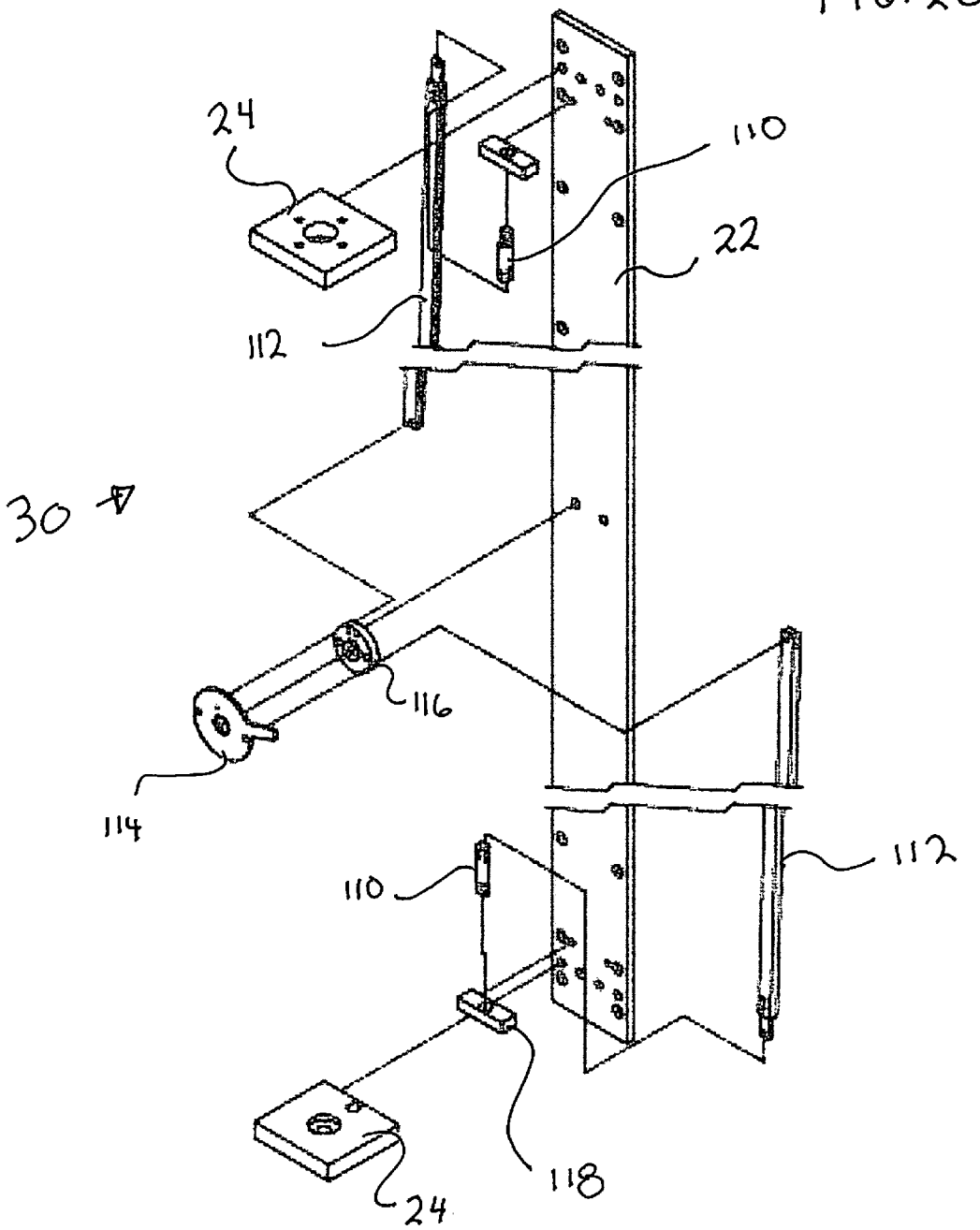
FIG. 20 is a perspective side assembly view of the screen locking assembly.

Looking at FIGS. 5 and 7-20 it can be seen that the screen assembly 6 is made of the screen mounting plate 22, spool mounting brackets 24, spool tube 16, torque assembly 26, stabilizer assembly 28, spool lock assembly 30, fabric screen barrier 14 and glue 100.

The screen mounting plate 22 is a planar, linear steel plate (FIG. 5) with to linear series of longitudinal orifices 32 formed therethrough to accommodate the passage of mechanical fasteners such as lag screws to affixed it to the studs 12 behind the wall. There is also an upper row 34 and lower row 36 of bolt orifices to accommodate the mechanical fasteners (bolts) that connect the parallel spool mounting brackets 24 perpendicularly to the front of the screen mounting plate 22 through the threaded bores in the body of the spool mounting brackets 24. Between these spool mounting plates 24 is captured the rotational, lockable spool 16. The spool 16 is right angled cylindrical tube with at a series of concave linear troughs 38 running along its length. These radially equidistant troughs 38 serve three purposes: as the groove to install and glue the distal end of the screen 14, to stiffen and add strength to the spool to help prevent it from distorting under lateral and torsional forces, and to allow the locking of the ends of the torque assembly 26 and the stabilizer assembly 28 to the spool tube 16. The spool tube 16 is constrained and allowed to rotate between the spool mounting brackets 24 at the top by the torque thrust bearing 40 and at the bottom by the identical stabilizer flanged sleeve thrust bearing 42.

Within the top end of the spool tube 16 resides the torque assembly 26 and within the bottom end of the spool tube 16 resides the stabilizer assembly 28. These are not connected directly to each other but are each connected to the spool tube 16 so as to form a single piece assembly. They use splined flanges 44 that matingly conform to the interior of the spool tube with its concave troughs 38 so as to lock any rotation of their ends having these splined flanges 44 to any rotation of the spool tube 16. Both the top end and the bottom end of the stabilizer assembly 28 has these splined flanges 44 and are locked to the spool tube 16, while only the bottom end of the torque assembly 26 has these splined flanges 44 and is locked to the spool tube 16.

The stabilizer assembly 28 is a hexagonal walled stiffener tube 64 that runs along the center of the spool tube 28 and is used to stiffen the length of the spool tube 16 from bending, buckling or twisting upon the application of any force to the fabric screen barrier 14 when it is extend across the wall opening. The stabilizer assembly 28 at its top end has an upper stud 60 that engages the hexagonal bore 62 running down the center of the stiffener tube 64. There is a circular flange 66 extending entirely around the approximate center of the upper stud 60 that rests on the top edge of the stiffener tube 64. The top section 68 of the upper stud 60 beyond the circular flange 66 is circular in cross section while its bottom section is hexagonal in cross section. The interior void of the circular bushing 70 is fitted onto the top section 68 of the upper stud 60 and the internal central circular bore of a splined flange 44 is fitted onto the exterior of the top section 68 of the upper stud 60. With the splined flange 44 conformed to the interior of the spool tube 16, the top end of the stiffener tube 64 is mated to the spool tube 16. (In the preferred embodiment this splined flange resides between the bottom one-third and the middle of the spool tube 16.)

At the bottom of the stiffener tube 64 is a lower stud 74. It has a top section 76 that is hexagonal in cross section, sized for mating engagement with the hexagonal bore 62 in the bottom end of the stiffener tube 64. The bottom section 78 of the lower stud 74 has a thrust bearing flange 78 extending normally therefrom that has a circular cross section. This circular thrust bearing flange 78 acts as a thrust bearing for the spool tube 167 and stiffener tube 64. It rests on the top face of the lower support plate 24 after it passes through the central bore 80 of a flanged sleeve bearing 42 that is fitted into the center bore 82 of the lower lock 84. The lower lock 84 has a lower lock cog 86 mated to a splined 44 flange conformed for mating engagement with the hexagonal bore 62 in the bottom end of the stiffener tube 64. The bottom face of the lower lock cog 86 has a circular recess for the flange of the flanged sleeve bearing 42 to reside. When assembled the lower stud 74 acts as a lower thrust bearing for the barrier 2 and the flanged sleeve bearing 42 acts as the spool tube's bottom rotational bearing. The lower lock cog 86 is used to lock the rotation of the spool tube 16.

The bottom end of the torque spring 52 of the torque assembly 26 is rigidly affixed to the top spool mounting bracket 34 by a bolted connection with lock plate 46 which is indirectly, rigidly connected to the bottom end of the torque assembly 26 by a double hex ended stud 48 that fits into matingly conformed hex recesses in both the lock plate 46 and the torque rod 50. The torque rod 50 passes through the longitudinal center of the torque spring 52 and is permanently affixed to the bottom end of the torque spring 52 by spring coupler 54 which is rigidly mounted onto the exterior of the torque rod 50. The spool tube 16 is rotationally supported around the torque rod 50 by mitered splines 44 which conform to the inside of the spool tube 16 and are mounted on plain bearings rotatable about central stud 88. This central stud 88 has a top section 90 that is hexagonal in cross section, sized for mating engagement with the hexagonal bore 92 running through the center of the torque rod 50. The bottom section 92 of the central stud 88 has a circular cross section that is frictionally fit into a plain circular bearing 94 that the splined flange 44 is mounted onto. The splined flange 44 matingly engages the inside of the spool tube 16. The spool tube 16 and its screen 14 freely rotate about the torque rod 50.

The top end of the torque assembly 26 has an upper lock 100. This has an upper lock cog 102 mated to a central mitered spline flange 44 which is coupled to a spring coupler 54. The spring coupler 54 is attached to the torque spring 52. The upper lock 100 has a plain bearing recess 104 formed therein to accommodate the frictional fit of flanged sleeve bearing 42 which acts as a thrust bearing and the spool tube's rotational bearing since it bears against the bottom face of the upper spool mounting bracket 24. This upper lock connects the spool tube 16 to the upper end of the torque spring 52. Thus, as the spool tube 16 is rotated the torques spring 52 winds from its top end. The upper lock cog 102 (as the lower lock cog 86) are locked to the spool tube 16 and rotate with it. However, the spool tube 16 rotates freely of the stiffener tube 84 and torque tube 50 by virtue of the bearings mounted between them and their splined flanges 4.

The central orifice in the lock plate 46 is conformed for mating engagement with the hexagonal configuration of the double hex ended stud 48. In this fashion the bottom end of the torque spring 52 cannot rotate. Only the top end of the torque spring 52 winds as the spool tube 16 is rotated. This design maintains the torque set between the spool tube 16 via the bottom end of the torque assembly 26 and the splined flanges 44. The double hex ended stud 48 extends beyond the top of the lock plate 46. The torque spring 52 is wound from the top end by turning the double hex ended stud 48 (and the lock plate 46 which it extends through), to a desired torque and then bolting the lock plate 46 to the top mounting flange 34 while the spool tube 16 is held stationary by engagement of the upper and lower locks. This torque force is minimal and is only needed to return the screen 14 into its cover 56. The majority of the torque is developed when the screen 14 is extended and the torque spring 52 winds.

The spool lock assembly 30 consists of an upper and lower locking tabs 110 that are pivotally mounted at the ends of upper and lower U shaped extension tubes 112 which are pivotally mounted on opposite sides of a rotatable lock disk 114. This lock disk 114 is pivotally mounted about its center, to the screen mounting plate 22. The other end of each extension tube 112 is pivotally mounted to opposing sides of the lock disk 114. There is a frictional bearing mounted between the lock disk 114 and the screen mounting plate 22. Extending from the screen mounting plate 22 adjacent the spool mounting brackets 24 are lock tab guides 118 that loosely constrain the upper and lower locking tabs 110 and hold them in perpendicular alignment with the lower lock cog 86 and the upper lock cog 102. Inside each locking tab 110 are two lock pin recesses 120 which frictionally constrain two lock pins 122. When the lock disk 114 is pivotally rotated via its lock lever 124, the pivot connections to the ends of the U shaped extension tubes 112 either raise and lower vertically to push the locking tabs 110 closer to the lower lock cog 86 and the upper lock cog 102 such that the two lock pins 122 engage the external teeth 126 around the periphery of the lock cogs and lock the rotation of the spool tube 16.

About the outside of the screen assembly 6 is a cover 56 that is removably mounted to a side cover plate 128 bolted to the upper and lower spool mounting brackets 24. There is a slit between the side cover plate 128 and the cover 56 that the screen 14 is extended through yet the screen handle 130 cannot pass. If the screen handle were to pass beyond this point, the screen return torque would be lost.

Figure 6:
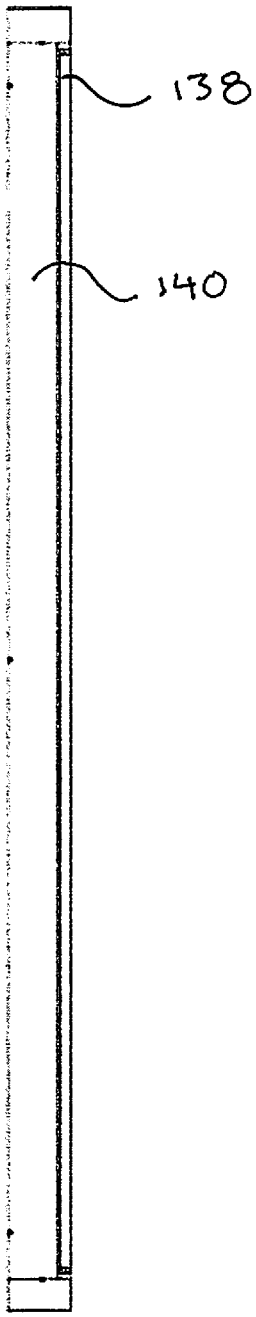
FIG. 6 is a front view of the screen capture plate.
Figure 24:
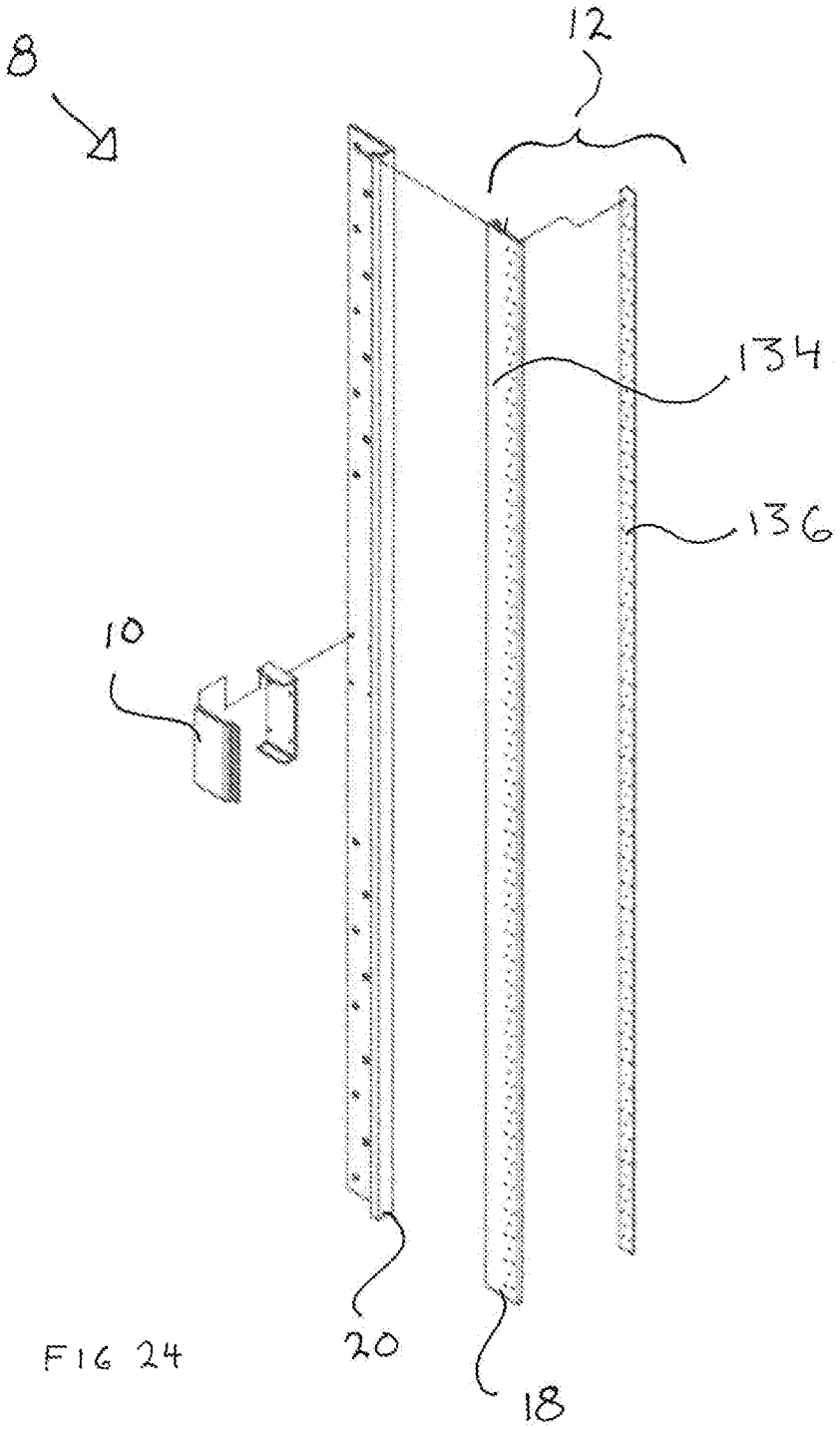
FIG. 24 is a side perspective view of the screen capture assembly.

Looking at FIGS. 6 and 24-26 the locking assembly 8 and method of attachment of the screen 14 can best be explained. On the extendible side of the barrier is a screen locking assembly made of a locking screen edge strip 134, a rivet plate 136 and a layer of glue 132 interspersed within the screen's openings and along both face edges of the screen 14. The screen 14 is sandwiched between the locking screen edge strip 134, and the rivet plate 136, held in place with the glue 132 as well as the frictional forces generated when the rivet plate 136 is riveted firmly to the locking screen edge strip 134. A pull handle 130 extends from the front face of the locking screen edge strip 134.

The leading edge of the locking screen edge strip 134 has a U shaped configuration along its length that is engageable with a lock flange 138 on the locking assembly mounting plate 140. The locking assembly mounting plate 140 is attached to the framing members (studs, concrete, etc.) at the side of the wall opening by suitable mechanical fasteners as described herein. The locking screen edge strip 134 is further constrained from removal off of the lock flange 138 by the bump lock 142.

A bump lock 142 is attached to the front face of the locking assembly mounting plate 140. Bump lock 142 is a section of steel channel 144 with an inwardly pivotable arm 146 spanning across its open concavity. A spring 148 connected between the rear edge of the pivotable arm 146 and the inside of the steel channel 144 serves to retract the arm 146. The arm 146 has a pivot 150 that allows the arm 146 to swing inward into the channel's concavity, and a section of angle steel 150 that abuts a flange 152 that extends from one of the sides of the steel channel 144. In operation, when the screen 14 is extended across the wall opening by the handle 130, the leading edge of the locking screen edge strip 134 is "bumped" against the pivotable arm 146 which swings inward and allows the U shaped configuration of the locking screen edge strip 134 to engage the lock flange 138 and securely restrain the screen 14 across the wall opening. The spring 148 returns the pivotable arm 146 to rest behind the leading edge of the locking screen edge strip 134 such that it cannot be dislodged from around the lock flange 138 during a blunt force assault on the barrier.

As can be seen from the above disclosure the barrier 2 has a structurally reinforced spool tube and uses a novel dual pin, dual spool lock, a secondary bump lock and a dual glue and sandwiched steel plate screen attachment to ensure the retention of the screen across the door and maintain the structural integrity of the spool tube against the application of forces to the screen.

While certain features and aspects have been described with respect to exemplary embodiments, one skilled in the art will recognize that numerous modifications are possible. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. A retractable security barrier, for affixation across a wall opening, comprising:

a screen assembly affixable to a first side of said wall opening;

a locking assembly affixable to an opposing second side of said wall opening; and a bump lock assembly affixed to said locking assembly;

wherein said screen assembly has a slash resistant, bullet resistant extendible screen coiled about a spool tube that is rotatably housed between an upper mounting bracket and a lower mounting bracket, each of said upper mounting bracket and said lower mounting bracket extending perpendicularly from a screen assembly mounting plate, said screen assembly mounting plate affixable with mechanical fasteners to said first side of said wall opening; and wherein said extendible screen has a first end edge affixed by a first glue to said spool tube permanently, and a parallel second end edge affixed with a second glue between a locking screen edge strip with a U shaped leading edge and a rivet plate of said locking assembly permanently; and wherein said bump lock assembly is affixed to a locking assembly mounting plate with a lock flange extending therefrom, said locking assembly mounting plate affixable with mechanical fasteners to said second side of said wall opening, and said bump lock assembly has an inwardly pivoting latch that contacts said U shaped leading edge of said locking screen edge strip when said locking screen edge strip is fitted around said lock flange, so as to prevent the removal of said extendible screen from across said wall opening.

2. The retractable security barrier of claim 1 wherein said spool tube is hollow and has a series of parallel linear concave troughs formed along a length of an exterior surface of said spool tube.

3. The retractable security barrier of claim 2 further comprising a torsion assembly mounted within an upper end of said hollow spool tube.

4. The retractable security barrier of claim 3 further comprising a stabilizer assembly mounted within a lower end of said hollow spool tube.

5. The retractable security barrier of claim 3 wherein said torsion assembly has a torque rod with a top end connected to said upper mounting bracket and a bottom end connected to a lower end of a torque spring wound about said torque rod, said torque spring having an upper end connected to said spool tube.

6. The retractable security barrier of claim 4 wherein said stabilizer assembly has a stabilizer rod affixed to an inner wall of the spool tube said by a pair of splined flanges.

7. The retractable security barrier of claim 5 further comprising:

a spool lock having an upper lock cog with a first set of external teeth formed on an outer periphery thereof, said upper lock cog attached to said torque spring;

a lower lock cog with a second set of external teeth formed on the outer periphery thereof, said lower lock cog attached to said stabilizer rod;

an upper locking tab with a first and second lock pin extending therefrom; a lower locking tab with a third and fourth lock pin extending therefrom;

a rotatable lock disk pivotally mounted to the screen mounting plate, said lock disk having an upper extension tube pivotally connected to said upper locking tab and a lower extension tube pivotally connected to said lower locking tab;

wherein said first and said second lock pins are insertable into said first set of external teeth by said upper extension tube to lock rotation of said upper lock cog and an upper end of said spool tube; and wherein said third and said fourth lock pins are insertable into said second set of external teeth by said lower extension tube to lock rotation of said lower lock cog and a lower end of said spool tube.

* * * * *